United States Patent [19]

Glode et al.

[11] 4,245,477

[45] Jan. 20, 1981

[54] INTERNAL HEATER MODULE FOR CRYOGENIC REFRIGERATORS AND STIRLING HEAT ENGINES

[75] Inventors: John B. Glode, Santa Monica; George P. Lagodmos, Rancho Palos Verdes, both of Calif.

[73] Assignee: The United States of America as represented by the Secretary of the Air Force, Washington, D.C.

[21] Appl. No.: 58,418

[22] Filed: Jul. 18, 1979

[51] Int. Cl.[3] ..... F25B 9/00; F01B 29/10; F02G 1/04

[52] U.S. Cl. ..... 62/6; 60/523

[58] Field of Search ..... 62/6; 60/517, 523

[56] References Cited

U.S. PATENT DOCUMENTS

| | | | |
|---|---|---|---|
| 2,127,286 | 8/1938 | Bush | 62/6 |
| 2,464,900 | 3/1949 | Stigter | 60/523 |
| 2,484,392 | 10/1949 | Van Heeckeren | 62/6 |
| 2,590,519 | 3/1952 | Du Pre | 62/6 |
| 2,621,474 | 12/1952 | Dros et al. | 60/523 |
| 3,319,416 | 5/1967 | Renshaw | 60/523 |
| 3,600,886 | 8/1971 | Jaspers | 62/6 |
| 3,853,437 | 12/1974 | Horn et al. | 62/6 |
| 3,862,546 | 1/1975 | Daniel | 62/6 |
| 3,892,102 | 7/1975 | Leo | 62/6 |
| 3,991,585 | 11/1976 | Mulder | 62/6 |

*Primary Examiner*—Lloyd L. King

*Attorney, Agent, or Firm*—Donald J. Singer; Arsen Tashjian

[57] ABSTRACT

Heat energy is supplied to the hot volume of a Vuilleumier cycle cryogenic refrigerator, or to a Stirling cycle heat engine, with and by the inventive heater module which is disposed within the hot working volume of the machine. The heater module is in contact with the working fluid within the hot volume, thereby more efficiently supplying heat energy to the machine. This invention accomplishes heat input to the most optimum place, namely: inside the hot volume. A preferred embodiment and a variation are taught.

3 Claims, 6 Drawing Figures

INTERNAL HEATER MODULE FOR CRYOGENIC REFRIGERATORS AND STIRLING HEAT ENGINES

STATEMENT OF GOVERNMENT INTEREST

The invention described herein may be manufactured and used by or for the Government for governmental purposes without the payment of any royalty thereon.

BACKGROUND OF THE INVENTION

This invention relates to a heating means and, more particularly, to a uniquely positioned and structured heater module for supplying heat energy to the hot volume of a Vuilleumier cycle cryogenic refrigerator, or to a Stirling cycle heat engine.

Vuilleumier cycle cryogenic refrigerators, and Stirling cycle heat engines, require heat input to the working fluid (which usually is a gas, such as helium) at or near the hot volume of the machine. The Vuilleumier cycle refrigerator, and the Stirling cycle engine, are closed cycle machines, i.e., the working fluid is contained, and there is no mass flow into or out of the machine. Because of this, all heat energy into or out of these machines must be accomplished by heat exchangers. The heat exchangers are typically located on the exterior surfaces of the machine, with a portion of the heat energy being wasted by heating insulation and/or chamber walls tha are not part of the machine itself.

Our invention places the heating element (or, the heating surface, as the case may be) within the working fluid, and allows the fluid to surround the heating element (or surface) for optimum heat energy transfer.

By our invention we have significantly advanced the state-of-the-art.

SUMMARY OF THE INVENTION

Our inventive heater module permits optimum heat energy transfer to the hot volume of a Vuilleumier cycle cryogenic refrigerator, or to a Stirling cycle heat engine, by placing the heating element (or surface) within the working fluid, and allowing the fluid to surround the element (or the surface).

Accordingly, the principal object of this invention is to teach the unique structure and positioning of our above-described heater module, by providing a preferred embodiment thereof. A variation is also taught which permits easy replacement of cartridge heating elements.

Other objects of this invention include: lowering the thermal mass of the heater module for quick "heat-up" of the machine; accomplishing the heat energy transfer with no electrical power leads inside the working fluid, if the heat input is by an electrical heater; eliminating or, at least, reducing the number (and, thereby, the cost) of machined parts; and, having the heating surface in compression, thereby allowing the use of ceramic parts and higher operating temperatures.

These objects, as well as other related objects, of this invention will become readily apparent after a consideration of the description of the invention, together with reference to the Figures of the drawings.

DESCRIPTION OF THE PRIOR ART AND OF THE PREFERRED EMBODIMENT AND THE VARIATIONS

As to the Prior Art

Figure 1:
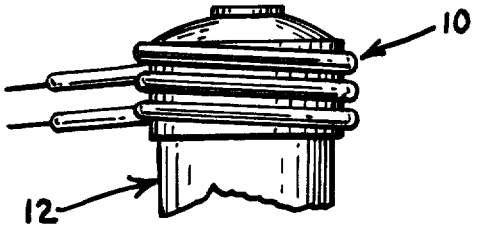
FIG. 1 PRIOR ART
FIG. 1 is a side elevation view, in simplified pictorial form, of a typical prior art electrical heater attached to the external surface of a hot cylinder of a closed cycle machine.

With reference to FIG. 1, therein is shown a typical prior art electrical heater 10 attached to the external surface of the hot cylinder 12. This manner of mounting and positioning the electrical heater 10, although common, is expensive; and, in addition, frequently results in having to scrape the entire hot cylinder 12 assembly, when the electrical heater 10 burns out.

Figure 2:
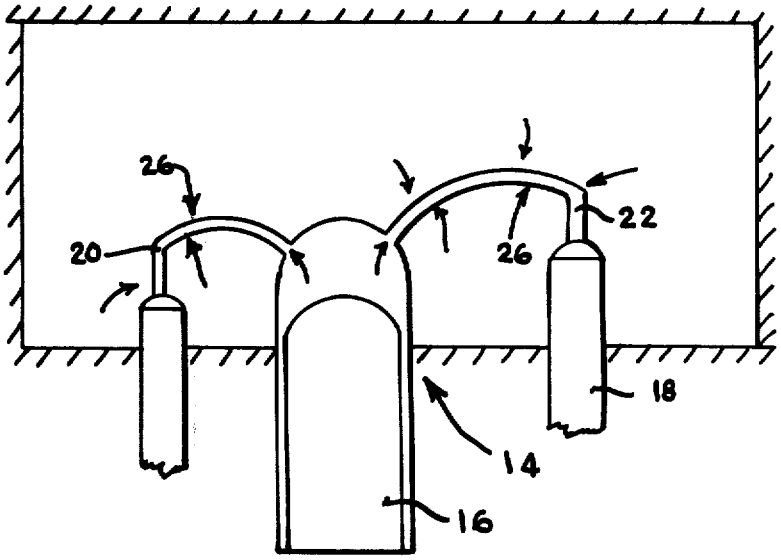
FIG. 2 PRIOR ART
FIG. 2 is a side elevation view, in simplified schematic form, partially in cross section and partially fragmented, of a typical prior art example of heating a Stirling cycle heat engine.

Now, with reference to FIG. 2, therein is shown a typical prior art example of heating a Stirling cycle heat engine, generally designated 14. Also referenced for easy identification by the reader are: the hot displacer 16; the hot regenerator 18; the gas tubes 20 and 22; and, the combustion chamber walls 24. The heat energy input to the gas tubes 20 and 22 is generally designated 26, and is schematically shown by impinging arrows.

As to the Preferred Embodiment

Figure 3:
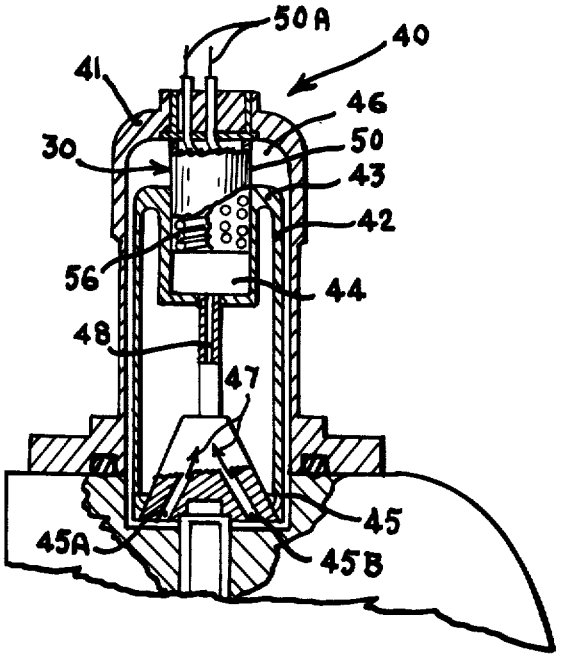
FIG. 3 is a side elevation view, in simplified schematic form, partially in cross section and partially fragmented, of a preferred embodiment of the invention.
Figure 4:
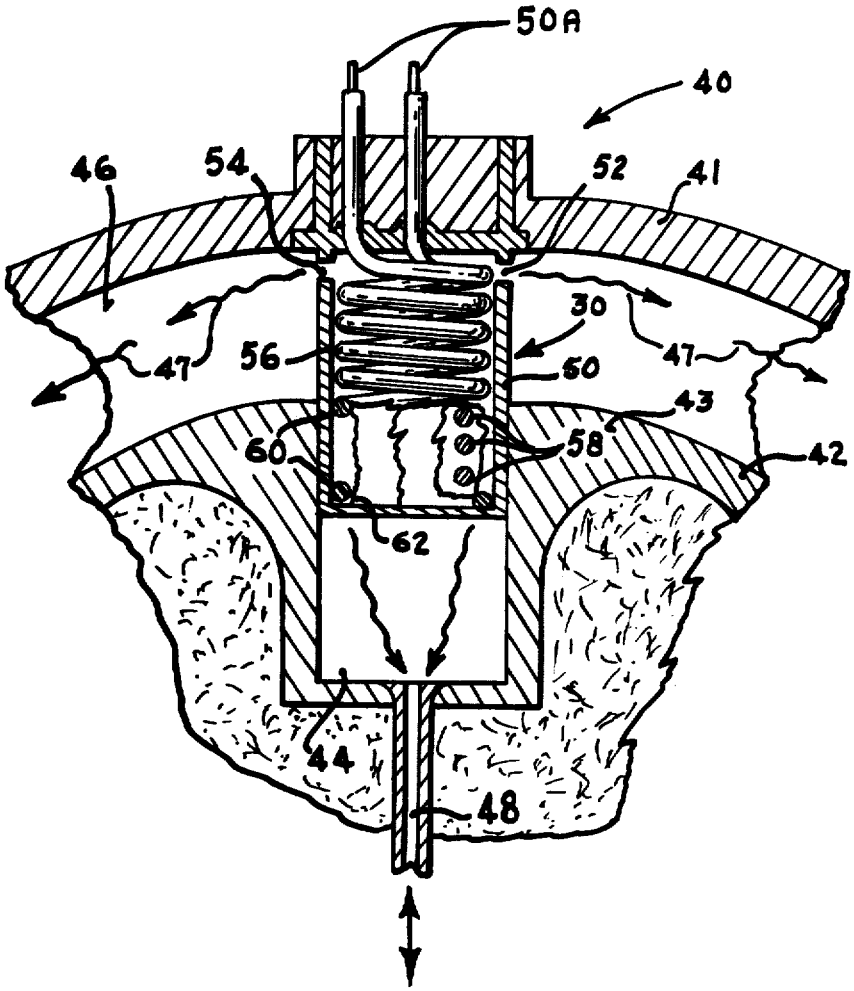
FIG. 4 is a side elevation view, enlarged and in greater detail, of a significant portion of the preferred embodiment shown in FIG. 1.

With reference to FIGS. 3 and 4, therein is shown the preferred embodiment 30 of our inventive internal heater module in its working environment.

As a preliminary matter, it is to be remembered that our internal heater module 30 is for use with a cryogenic refrigerator, or a Stirling cycle heat engine, or the like (i.e., a closed cycle machine or, more accurately, an expansion engine which incorporates a body movable within a fluid-tight housing to define therein one or more refrigeration chambers of variable volume). More specifically, the representative cryogenic refrigerator (such as 40, FIGS. 3 and 4) has: a hot cylinder (such as 41, FIGS. 3 and 4); a hot displacer (such as 42, FIGS. 3 and 4) that is disposed within the hot cylinder 41, and which has a top (such as 43, FIGS. 3 and 4) with a centrally located cavity (such as 44, FIGS. 3 and 4) therein, and which also has a base (such as 45, FIGS. 3 and 4) with flow passages or passageways therethrough, (such as representative ones 45A and 45B, FIG. 3); a hot volume (such as 46, FIGS. 3 and 4); working fluid (such as is designated by arrows collectively generally designated 47, FIG. 4); and, a centrally positioned working fluid passage member (such as 48, FIGS. 3 and 4) that interconnects the flow passages 45A and 45B in the base 45 of the hot displacer 42 with the cavity 44 in the hot displacer 42.

Still with reference to FIGS. 3 and 4, our internal heater module 30 comprises, in its most basic and generic structural form: a tubular member 50, FIGS. 3 end 4, having a top with a plurality of radial slots (such as representative ones 52 and 54, FIG. 4) therethrough, with the tubular member 50 disposed within, and closely fitted to, the hot dispenser cavity 44, as can be seen in FIGS. 3 and 4; and, a double wound, electric, heater coil member 56, FIGS. 3 and 4, having an inner coil 58, FIG. 4, and an outer coil 60, FIG. 4, that are separated by a metallic screen 62, FIG. 4, with the electric heater coil member 56 disposed within the tubular member 50, as can be seen in FIGS. 3 and 4.

As to the Variation

Figure 5:
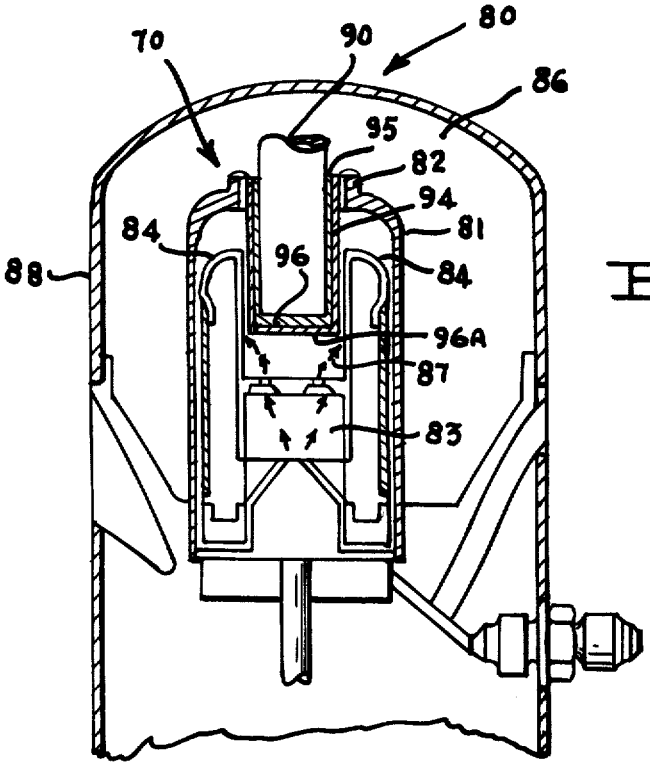
FIG. 5 is a side elevation view, in simplified schematic and pictorial form, partially in cross section and partially fragmented, of a variation of the preferred embodiment, in which a cartridge heating element is used.

Now, with reference to FIGS. 5 and 5, therein is shown a variation of the preferred embodiment 30 of our inventive internal heater module that is shown in FIGS. 3 and 4.

Figure 6:
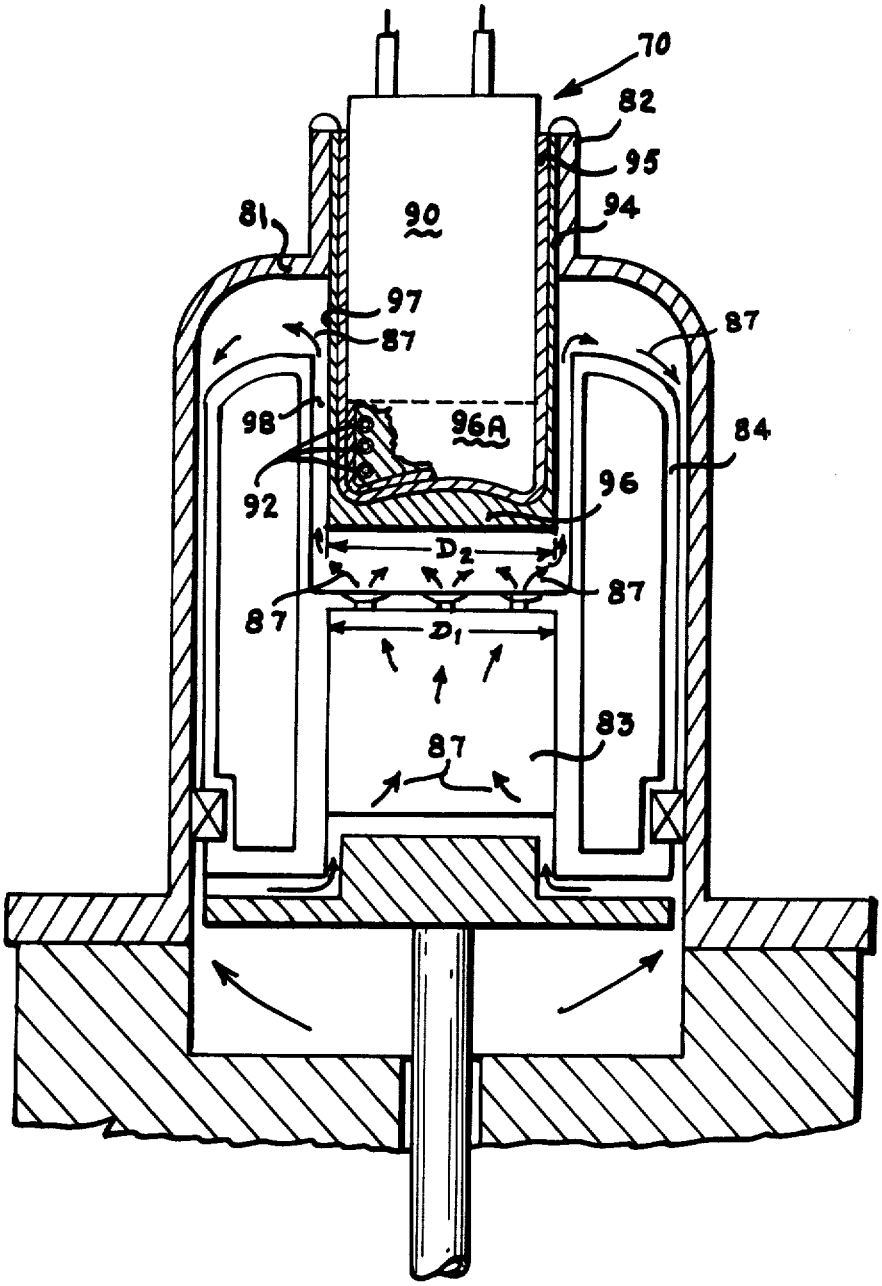
FIG. 6 is a side elevation view, enlarged and in greater detail, of a significant portion of the variation shown in FIG. 5.

It is here to be noted, and to be remembered, that this variation 70, FIGS. 5 and 6, is for use with a cryogenic refrigerator (such as 80, FIGS. 5 and 6) or the like, as set forth above herein, that has: a hot cylinder (such as 81, FIGS. 5 and 6) with a top (such as 82, FIGS. 5 and 6); and annular shaped hot displacer (such as 84, FIGS. 5 and 6) which is disposed within the hot cylinder 81; a hot volume (such as 86, FIGS. 5 and 6); working fluid (such as is designated by arrows collectively generally designated 87, FIGS. 5 and 6); and, an exterior (such as 88, FIG. 5).

Still with reference to FIGS. 5 and 6, our first variation 70 comprises: a sheated, electronic, heater member 90, FIGS. 5 and 6, that is preferably of the cartridge type, and that has a heating element portion 92, FIG. 6; and, a cylindrical shaped well member 94, FIGS. 5 and 6, that surrounds and closely fits the heater member 90, with the well member 94 having an open first end 95, a closed second end 96 with a hot surface 96A, and a cylindrical surface 97 between the first and second ends 95 and 96. The well member 94 is affixed to the top 82 of the hot cylinder 81, and forms and defines a boundary surface between the internal working fluid 87 and the exterior 88 of the refrigerator 70. The hot surface 96A of the closed second end 96 of the well member 94 is disposed adjacent to the heating element portion 92 of the heater member 90. The cylindrical surface 97 of the well member 94 abuts with the hot cylinder 81, and also is adjacent to the hot displacer 84. Thereby, an annular space 98, FIGS. 5 and 6, is formed between the well member 94 and the hot displacer 84.

It is also to be noted that the cryogenic refrigerator 70 has a hot regenerator (such as 83, FIGS. 5 and 6) with a diameter (such as D1, FIG. 6), and that the closed second end 96 of well member 94 also has a diameter (such as D2, FIG. 6). As a matter of preference, and not of limitation, the diameters D1 and D2 are equal, to simplify the structure.

MANNER OF OPERATION OF THE PREFERRED EMBODIMENT AND VARIATIONS

The manner of operation of the preferred embodiment 30, FIGS. 3 and 4, and of the variation thereof 70, FIGS. 5 and 6, can be easily ascertained by any person of ordinary skill in the art from the foregoing description, coupled with reference to the Figures of the drawings.

For others, the following explanation is set forth:

As to the Preferred Embodiment

The heating module 30, FIGS. 3 and 4, is stationary, and the electrical connections 50A, FIGS. 3 and 4, to the electric heater coil member 56, FIGS. 3 and 4, are outside of the working volume 46, FIG. 3, of the machine 40. In this regard, it is to be noted that, if the electrical connections or leads, were to be inside the working volume, there would be at least two disadvantages, to wit: the connections or leads would have to cross the gas interface of the machine; and, the hardware implementation would be significantly more costly, both in machined parts and in assembly effort.

Again, with reference to the operation of the preferred embodiment 30, FIGS. 3 and 4, in essence the working fluid 47, FIGS. 3 and 4, flows past our heater module 30 (and the electric heater coil member 56 thereof) as it (i.e., the working fluid 47) is forced into and out of the hot volume 46 of the machine 70 by the hot displacer 42, FIGS. 3 and 4. More specifically, gas flow to and from the hot volume 46 is accomplished by flow passages or passageways 45A and 45B, FIG. 3, in the base 45, FIG. 3, of the hot displacer 42, meeting with centrally positioned working fluid passage member 48, FIGS. 3 and 4, which leads to and from the centrally located cavity 44 in the hot displacer 42, and then through the internal heating module 30, and out of the plurality of radial slots, such as representative ones 52 and 54, FIG. 4, that are in the top of the tubular member 50, FIG. 4, of the internal heater module 30 (and, of course, out of the heater module 30).

As to the Variation

With reference to the variation 70, FIGS. 5 and 6, of our invention 30, the heating element portion 92, FIG. 6, of the sheated, electric heater member 90 is concentrated only at the (bottom) end thereof, causing a hot surface 96A, FIGS. 5 and 6, that is deep within the well member 94. Heat energy transfer to the gas 87 that is flowing past the well member 94 is controlled by the surface temperature of the well member 94, and the annular space (i.e., clearance) 98, FIG. 6, between the well member 94 and the hot displacer 84.

It is to be noted, as a related matter, that the heater module 90 in this variation 70 (which, preferably is of the cartridge type) can be very easily replaced, if necessary.

CONCLUSION

It is abundantly clear from all of the foregoing, and from the Figures of the drawings, that the stated desired objects, as well as other related objects, of our inventive internal heating module have been achieved.

It is to be noted that, although there have been described and shown the fundamental and unique features of our invention as applied to a preferred embodiment and to a variation thereof, various other embodiments, variations, adaptations, substitutions, additions, omissions, and the like may occur to, and can be made by, those of ordinary skill in the art, without departing from the spirit of the invention. For example, another variation of an internal heater module, in accordance with our concept, can comprise a gas combustion burner heater member (rather than an electric heater member), and such a gas combustor burner heater member may be used with a cryogenic refrigerator having: a hot cylinder with a top in which there is a centrally located cavity; and, a hot displacer disposed within the hot cylinder, with the hot displacer having a top that is complementary in shape to the cavity in the hot cylinder. In such a variation, the gas combustion burner heater member is positioned within the centrally located cavity of the hot cylinder, and external of the hot cylinder.

What is claimed is:

1. An internal heater module, for use with a cryogenic refrigerator having a hot cylinder, a hot displacer disposed within said hot cylinder and having a top with a centrally located cavity therein and a base with flow passageways therethrough, a hot volume, working fluid, and a centrally positioned working fluid passage member interconnecting said hot displacer flow passageways and said hot displacer cavity, comprising:

a. a tubular member having a top with a plurality of radial slots therethrough, wherein said tubular member is disposed within, and is fitted closely to, said hot displacer cavity;

b. and, a double wound electric heater coil member having an inner coil and an outer coil separated by a metallic screen, with said electric heater coil member disposed within said tubular member;

whereby working fluid flow to and from said hot volume is accomplished through said flow passageways in said base of said hot displacer, through said centrally positioned working fluid passage member, through said hot displacer cavity, through said plurality of radial slots in said top of said tubular member of said internal heater module and, thereby, through said heater module.

2. An internal heater module for use with a cryogenic refrigerator having a hot cylinder with a top, an annular shaped hot displacer disposed within said hot cylinder, a hot volume, internal working fluid, and an exterior, comprising:

a. a sheathed electric heater member of the cartridge type having a heating element portion;

b. and, an cylindrical shaped well member surrounding and closely fitting said heater member, with said well member having an open first end, a closed second end having a hot surface, and a cylindrical surface between said first and second ends, and with said well member affixed to said top of said hot cylinder and forming and defining a boundary surface between said internal working fluid and said exterior, and also with said hot surface of said closed second and of said well member disposed adjacent said heating element portion of said heater member, and with said cylindrical surface of said well member abutting said hot cylinder and adjacent to said hot displacer, thereby an annular space is formed between said well member and said hot displacer;

whereby heat energy transfer to said working fluid flowing past said well member is controlled by a surface temperature of said well member and said annular space between said well member and said hot displacer.

3. An internal heater module, as set forth in claim 2, wherein said cryogenic refrigerator has a hot regenerator with a diameter, and wherein said closed second end of said well member has a diameter, and said diameters are equal.

* * * * *